US006065533A

United States Patent [19]

Woodhull, Jr.

[11] Patent Number: 6,065,533

[45] Date of Patent: May 23, 2000

[54] FLAT TUBE HEAT EXCHANGER

[75] Inventor: Ivan D. Woodhull, Jr., Flat Rock, Mich.

[73] Assignee: Karmazin Products Corporation, Wyandotte, Mich.

[21] Appl. No.: 09/186,747

[22] Filed: Nov. 5, 1998

Related U.S. Application Data

[63] Continuation of application No. 08/764,304, Dec. 12, 1996, abandoned.

[60] Provisional application No. 60/008,624, Dec. 14, 1995, abandoned.

[51] Int. Cl.[7] ..... F28D 1/00

[52] U.S. Cl. ..... 165/149; 165/153; 165/166; 228/175

[58] Field of Search ..... 165/174, 166, 165/153, 152, 151, 149, 148; 228/175

[56] References Cited

U.S. PATENT DOCUMENTS

| | | | |
|---|---|---|---|
| 1,679,517 | 8/1928 | Fedders . | |
| 1,680,673 | 8/1928 | Fedders . | |
| 1,683,340 | 9/1928 | Fedders . | |
| 1,940,804 | 12/1933 | Karmazin . | |
| 2,016,164 | 10/1935 | Williams . | |
| 2,059,114 | 10/1936 | Karmazin | 165/174 |
| 2,134,665 | 10/1938 | Karmazin | 165/174 |
| 2,595,440 | 5/1952 | Austin . | |
| 2,672,324 | 3/1954 | Weiss . | |
| 2,886,295 | 5/1959 | Betzer . | |
| 2,918,265 | 12/1959 | Williams et al. . | |
| 2,983,483 | 5/1961 | Modine . | |
| 3,360,038 | 12/1967 | Stampes . | |
| 3,554,150 | 1/1971 | Goetschius et al. . | |
| 3,703,925 | 11/1972 | Ireland et al. . | |
| 3,783,938 | 1/1974 | Chartet . | |
| 3,835,923 | 9/1974 | Platell . | |
| 3,912,003 | 10/1975 | Schrade . | |
| 4,016,928 | 4/1977 | Bartels et al. . | |
| 4,263,966 | 4/1981 | Östbo . | |
| 4,344,388 | 8/1982 | Stevens . | |
| 4,509,672 | 4/1985 | Woodhull, Jr. et al. . | |
| 4,708,199 | 11/1987 | Yogo et al. . | |
| 4,775,007 | 10/1988 | Sakuma et al. . | |
| 5,009,263 | 4/1991 | Seshimo et al. . | |
| 5,114,776 | 5/1992 | Cesaroni . | |
| 5,226,235 | 7/1993 | Lesage . | |
| 5,318,112 | 6/1994 | Gopin . | |
| 5,373,895 | 12/1994 | Yamamoto et al. . | |
| 5,529,120 | 6/1996 | Howard et al. . | |

*Primary Examiner*—Christopher Atkinson
*Attorney, Agent, or Firm*—Harness, Dickey & Pierce P.L.C.

[57] ABSTRACT

A heat exchanger is disclosed which is designed to be fabricated from sheet material. The heat exchanger core assembly comprises a plurality of stacked substantially identical strips of formed sheet members each having a plurality of troughs formed therein. The troughs are positioned in nested relationship so as to define fluid flowpaths through the core assembly and between headers secured to opposite ends of the core assembly. Each of the troughs includes a bottom portion having a plurality of openings therein through which fluid may flow. In one embodiment the openings are in the form of louvers. In another embodiment, the openings are rectangularly shaped and offset between successive strips in the stack so as to impart a mixing action to the fluid flowing through the core. Heat radiating fin portions separate the respective fluid flowpath defining troughs and may include louvered-like openings therein. A method of fabricating the heat exchanger is also disclosed.

27 Claims, 5 Drawing Sheets

FLAT TUBE HEAT EXCHANGER

This is a continuation of U.S. patent application Ser. No. 08/764,304, filed Dec. 12, 1996 now abandoned which was a provisional application Ser. No. 60/008,624, filed Dec. 14, 1995 now abandoned.

BACKGROUND AND SUMMARY OF THE INVENTION

The present invention relates generally to heat exchangers and more specifically to stacked fin and tube type heat exchangers.

Stacked fin and tube type heat exchangers generally are fabricated from sheet metal stock in which a plurality of protrusions are formed which are open at both ends thereof and are positioned in side by side relationship in an elongated strip of material of a width typically equal to the thickness of the desired heat exchanger. Typically, each strip will have a plurality of rows of such protrusions positioned in side-by-side spaced relationship. These strips are then cut to a desired length and stacked with the protrusions of adjacent sheets being nested together to thereby form fluid flow paths through the stacked sheets. Suitable headers are secured to opposite ends of the stacked sheets or strips and the entire assembly may then be subject to a brazing operation to thereby fixedly secure the components in fluid tight sealing relationship. Such a heat exchanger construction is shown in U.S. Pat. No. 4,509,672 issued Apr. 9, 1985 and assigned to the same assignee as the present application.

Such nested, stacked fin and tube type heat exchangers offer excellent high strength extremely durable type heat exchangers which are particularly well suited for industrial type applications such as cooling hydraulic fluids on large construction equipment. However, the volume of fluid flow through a given size heat exchanger of this type is limited because of the necessary spacing required between the respective fluid flow path defining protrusions. Further, the protrusions are formed by a relatively slow press operation which tends to be time consuming and hence relatively costly.

In another type of heat exchanger, strips of sheet stock material is folded into an accordion or corrugated pattern. The accordion strips are then stacked with the folds of each strip extending in alternating directions and flat plates being positioned therebetween. Flat bars are also placed along the sides and ends in alternating fashion for each layer to thereby define fluid flow paths. While this type of construction offers ample cross-sectional area to accommodate high volume fluid flow, the corrugated strips of one layer are only aligned with the corrugated strips of the next layer at spaced points along each fold. This arrangement thus results in an impairment of the thermal heat transfer efficiency of such heat exchangers.

The present invention, however, provides an improved heat exchanger construction in which strip type sheet stock is formed with a plurality of laterally extending troughs positioned in longitudinally spaced relationship along the length of the strip stock. In one form the bottom surface of each trough is pierced to form a plurality of louvered like openings therein. The thus formed strips maybe cut to a desired length, stacked in a nested relationship and the laterally open ends thereof closed by sealing strips. Suitable header plates may then be secured to opposite ends of the stacked strips and the entire assembly subject to a brazing operation to secure the assembly together after which header covers are secured to the header plates to complete the heat exchanger. In another embodiment a plurality of relatively large spaced openings are formed in the bottom surface of each of the troughs. The openings are positioned such that when the respective cut to length strips are stacked to form the heat exchanger core, the openings will be offset from one strip to the next to thereby impart a turbulent flow pattern to the fluid flowing therethrough. This turbulent flow pattern aids in ensuring maximum cooling of the fluid by the heat exchanger. Additionally, in some applications, the surfaces of the strips positioned between the adjacent troughs may be pierced with louver-like openings to increase heat transfer to the air flowing thereacross.

As thus formed, the troughs of the stacked strips form fluid flow paths extending across the full width of the heat exchanger thus providing a greater cross-sectional area for fluid flow for a given size heat exchanger as compared to the prior fin and tube type construction discussed above. Further, the individual strips are suited for rapid and economical fabrication by a high speed press operation or possibly at least in part by a continuous roll forming operation which minimizes the lost cycle time incurred in a reciprocating press forming operation. Additionally, the heat exchanger of the present invention is designed such that the bottom of each trough is positioned in substantially laterally aligned relationship with the intermediate fin forming portion of another strip member to thereby ensure a direct and short heat transfer path to the heat radiating fin portion. Further, the troughs are designed such that when nested, the sidewall portions thereof overlap thereby forming a double wall thickness for the fluid flow path which not only assures a high strength heat exchanger capable of handling fluids under substantial pressure but also assures a substantial surface area for creating a sealing relationship between adjacent strip members. Additionally, the double wall construction allows the use of thinner sheet stock thus facilitating the forming operation without reducing the strength of the resulting heat exchanger. The present construction is well suited for fabrication of heat exchangers from a variety of materials such as steel or aluminum and in particular for the use of materials having one or both sides coated with a cladding of a lower melting point material to facilitate brazing of the components into a fluid tight sealed relationship.

Additional advantages and features of the present invention will become apparent from the subsequent description and the appended claims, taken in conjunction with the accompanying drawings.

DESCRIPTION OF THE PREFERRED EMBODIMENTS

Figure 1:
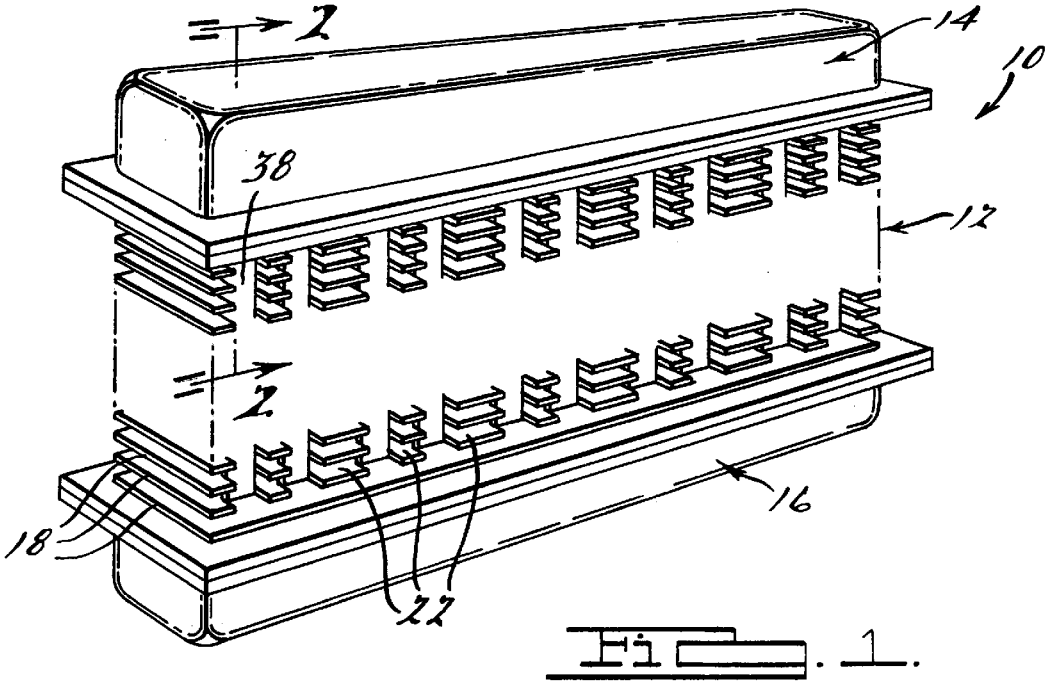
FIG. 1 is a perspective view of a nested flat tube heat exchanger in accordance with the present invention.
Figure 2:
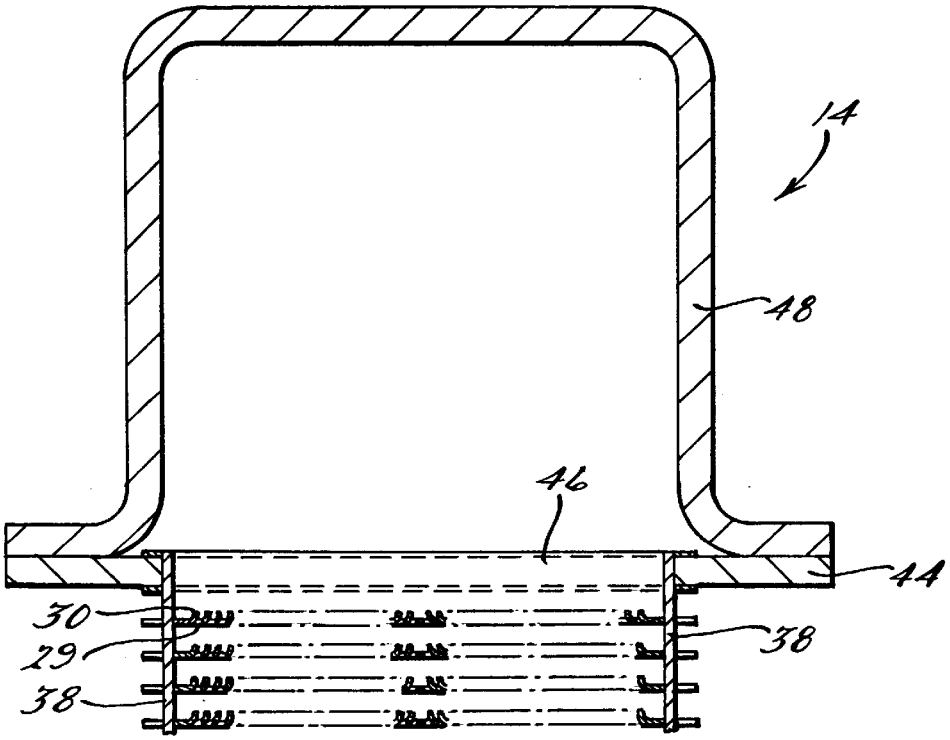
FIG. 2 is a fragmentary section view of the heat exchanger of FIG. 1, the section being taken along line 2—2 thereof.

Referring now to the drawings and more specifically to FIG. 1, there is shown a heat exchanger in accordance with the present invention shown generally at 10. Heat exchanger 10 includes a core assembly 12 of nested integral flat fin and tube construction with headers 14 and 16 secured to opposite ends thereof both of which will be provided with suitable fittings for conducting a fluid to be cooled to and from the heat exchanger.

Figure 3:
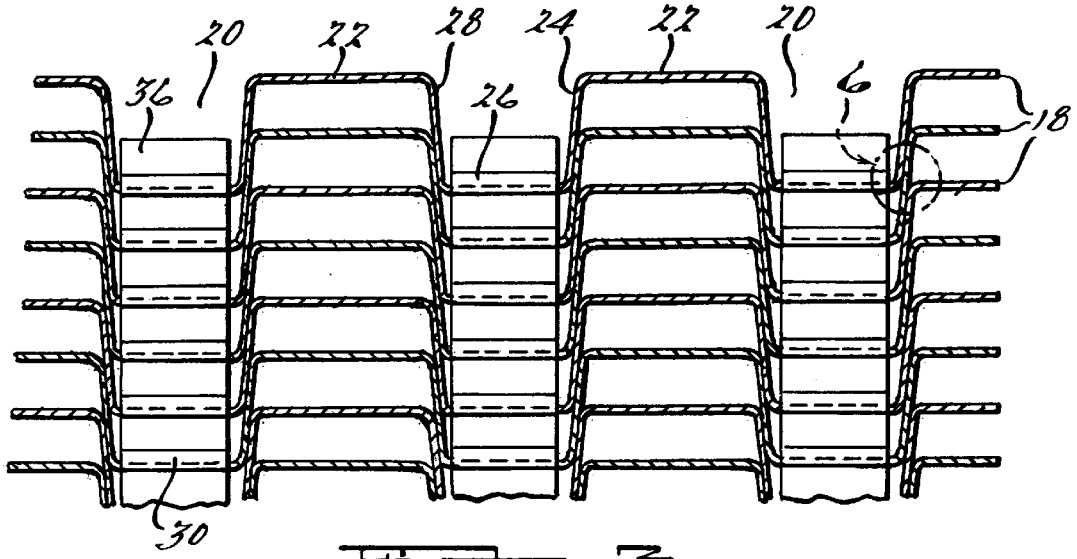
FIG. 3 is a fragmentary section view showing a portion of the core of the heat exchanger shown in FIG. 1, the section being taken along a plane extending laterally along the width of the heat exchanger and lying along the direction of fluid flow.
Figure 4:
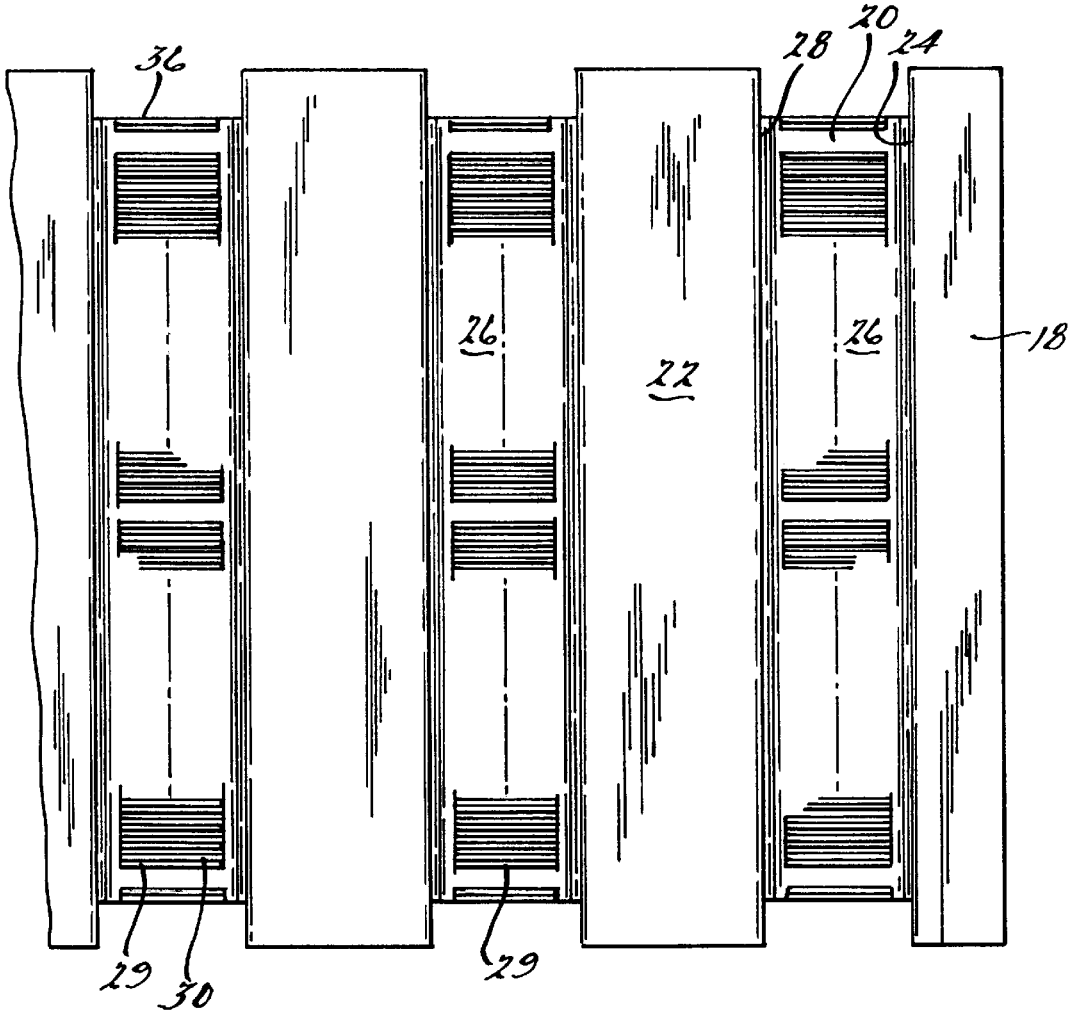
FIG. 4 is a fragmentary plan view of the heat exchanger core shown in FIG. 3 all in accordance with the present invention.

As best seen with reference to FIGS. 3 and 4, core assembly 12 comprises a plurality of substantially identical elongated formed strips 18 each of which includes a plurality of laterally extending, substantially identical, spaced substantially parallel troughs 20. Formed strips 18 are generally rectangular in shape having a predetermined width and length and are designed to be easily and conveniently formed from sheet metal stock in a suitable manner such as by a high speed press operation. Alternatively, strips 18 may be formed by a roll forming operation. As shown, each strip 18 includes a first substantially flat portion 22 extending laterally for the full width thereof and having a predetermined dimension in the longitudinal direction.

Trough 20 is defined by a first laterally elongated sidewall portion 24 extending downwardly from flat portion 22 and forming an included angle with the adjacent flat portion slightly greater than 90°. A laterally elongated bottom wall portion 26 of a predetermined dimension in the longitudinal direction of strip 18 is formed extending from the lower edge of sidewall 24 and terminates at a second substantially planar laterally elongated sidewall portion 28 which extends upwardly to a next adjacent flat portion 22. As with sidewall portion 24, sidewall portion 28 forms an included angle with the next adjacent flat portion slightly greater than 90°. Strips 18 may be continuously formed and then severed to any desired length with the above sequence of portions (i.e. flat, sidewall, bottom wall and sidewall) being repeated along the length thereof. As is apparent, strip 18 may be severed midway along the length of flat portion 22. Thus, the flat portions at opposite ends of the heat exchanger will have a length (in the longitudinal direction of strip 18) equal to about one half of the other flat portions. Thus, manufacturing operations may be easily adjusted to switch from one length heat exchanger core to another by merely adjusting the point at which successive strips 18 are severed.

In the embodiment shown in FIGS. 2–8, bottom wall 26 includes a plurality of substantially identical spaced openings 29 therein each extending in the longitudinal direction of strip 18 and having a length slightly less than the width of bottom wall 26. These openings 29 are preferably formed by slitting the sheet metal around 3 sides of the opening and deforming the thus formed tab 30 upwardly between sidewall portions 24 and 28 such that the tabs 30 extend substantially perpendicular to the surface of bottom wall portion 26 and are operative to disturb fluid flow through said troughs so as to minimize the occurrence of temperature gradients in the fluid flowing through the troughs.

Figure 5A:
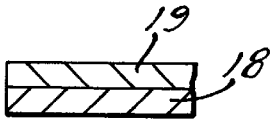
FIG. 5*a* is an enlarged section view of a portion of the strip of FIG. 5, the section being taken along line 5*a*—5*a*.
Figure 5:
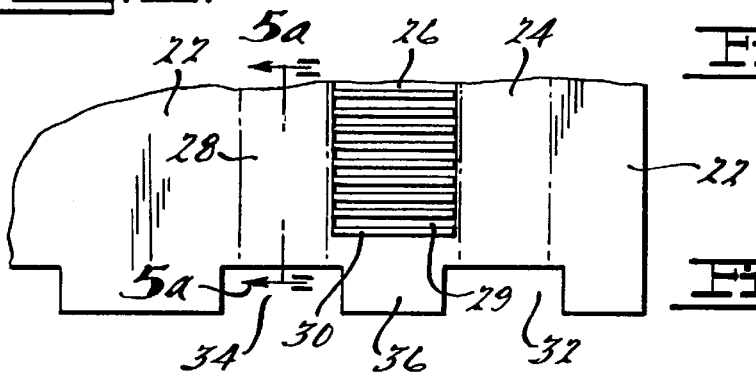
FIG. 5 is a plan view of a portion of a strip member showing the trough forming portion thereof prior to final forming thereof, all in accordance with the present invention.
Figure 8:
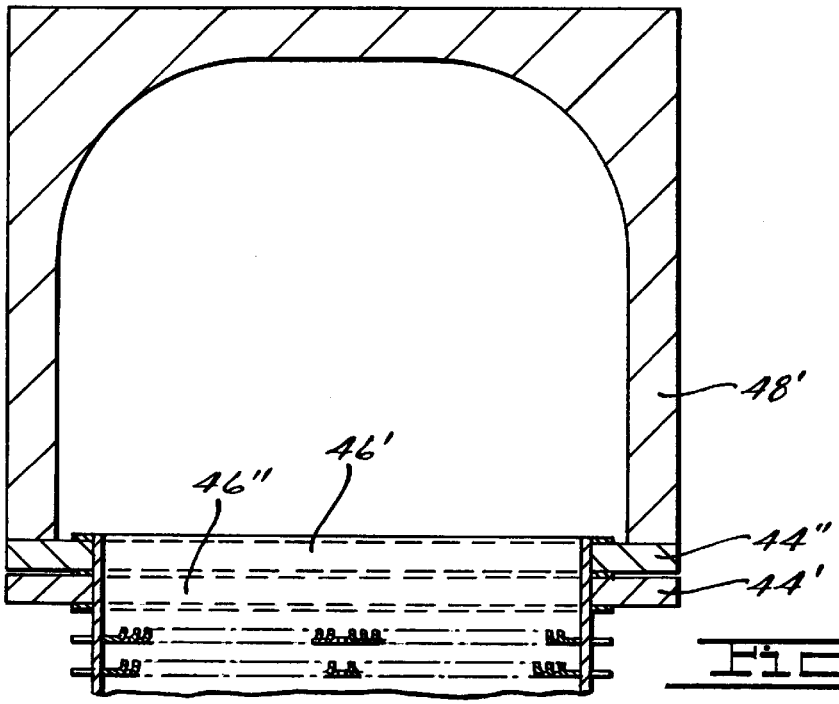
FIG. 8 is a section view similar to that of FIG. 2 but showing an alternative high pressure header construction in accordance with the present invention.

As shown in FIG. 5, substantially identical spaced notches or cutouts 32 and 34 are formed at irregular intervals along opposite sides of strip 18. The location of these cutouts corresponds to the portion of strip 18 which will define sidewall portions 24 and 28 and define a tab portion 36 therebetween. Tab portions 36 are thereafter formed to extend upwardly between sidewall portions 24 and 28 and generally perpendicular to bottom wall portion 26 as shown in FIGS. 3 and 4 so as to form an abutment and attachment surface for end closure member 38 described below.

Figure 6:
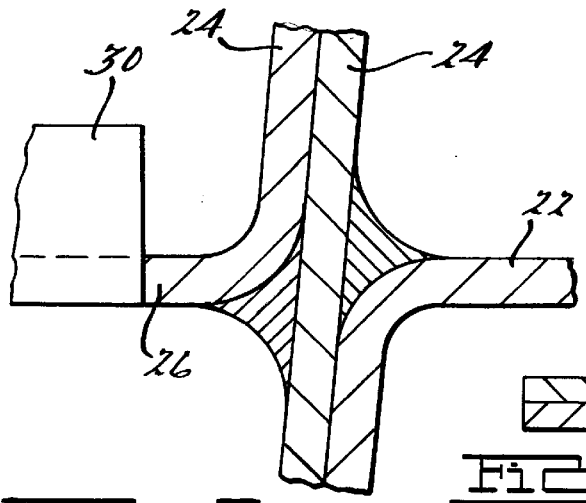
FIG. 6 is an enlarged view of the area enclosed in circle 6 of FIG. 3 showing the interconnection and relative positioning of the nested sheet strips forming the heat exchanger core.

Once strips 18 have been formed to define a plurality of alternating troughs 20 and flat portions 22 it is cut to a desired length at a point substantially bisecting a flat portion 22. Successive ones of the thus formed and cut to length strips 18 are then assembled with respective troughs 20 being nested together as best seen with reference to FIG. 3. Preferably the tapering angulation of sidewall portions 24 and 28 of each trough will be selected so as to ensure a substantial area of engagement with the inner surfaces of sidewall portions 24 and 28 of strip 18 positioned immediately below and also to position bottom wall portion in substantially coplanar relationship with flat portions 22 of the next lower strip 18 as shown in FIG. 6. This relationship ensures a direct heat conduction path of minimum distance from bottom wall portion 26 to the adjacent heat radiating fins defined by adjacent flat portions 22. Additionally, the overlapping wall portions 24 and 28 of adjacent strips are such as to form a wall thickness for the fluid flow path defined by troughs 20 substantially equal to twice the thickness of the material used to form strips 18.

Figure 7:
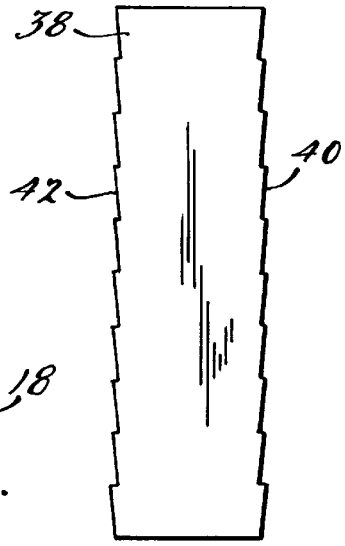
FIG. 7 is a view showing an end closure strip used to close the open lateral ends of the troughs in the heat exchanger of FIG. 1.

Also shown in FIG. 7, end closure member 38 comprises an elongated strip having a length substantially equal to the height of the core 12 formed by stacked strips 18 with the opposite lateral edges 40 and 42 being formed with a generally saw toothed shape conforming to the shape defined by the respective sidewall portions 24, 28 of the stacked strips 18 of core 12. End closure members 34 may be sealingly secured in abutting relationship to tabs 36 and sidewalls 24 and 28 of strips 18 in any suitable manner such as by welding or brazing so as to overlie and dose off opposite ends of troughs 20 thereby defining a closed fluid flow path between the two headers.

In order to attach headers 14 and 16 to opposite ends of core 12, a plate member 44 having a plurality of laterally extending spaced openings 46 positioned so as to be aligned with respective troughs 20 is secured to the upper and lower most strips 18 of core 12. Thereafter, the header cover member 48 is secured to plate 44 in any suitable manner such as by welding or brazing.

As thus assembled, the enclosed space defined by cover member 48 and plate 44 is in fluid communication with each of the fluid flow paths defined by slotted troughs 20. Thus, fluid to be cooled by heat exchanger 10 enters one of headers 14 and 16 and flows through each of the fluid flow paths defined by the stacked troughs 20 of strips 18 to the other header. The unique design of the present invention enables manufacturing operations to easily and readily accommodate a wide variety of heat exchangers of varying height and width by merely changing the number and/or length of the elongated strips 18. It should also be noted that heat exchangers of varying thickness or depth may also be easily formed using the present invention by merely arranging multiple stacks of nested strips 18 in back-to-back relationship and assembling same with header plates having multiple rows of openings therein. For example, assuming that strips 18 are fabricated from 1" wide roll sheet metal, heat exchangers of thicknesses in 1" increments can easily be fabricated therefrom. Further, the nested arrangement of the stacked strips results in a double wall thickness thereby enabling use of thinner sheet metal stock for fabricating the individual strips without any loss of resulting strength in the core assembly.

Referring now to FIG. 7, an alternative header construction is shown which is specifically designed for higher pressure applications. In this embodiment two plate members 44' and 44" are secured together and to the one end of the core assembly 12. A cover member 48' of substantially greater wall thickness then cover member 48 is then secured to plate member 44' and 44" thus forming a header assembly of substantially greater wall thickness which is able to withstand substantially higher pressures than the header assembly of FIG. 2. Of course, the sheet material used to form core assembly 12 may be of greater thickness as well.

Figure 9:
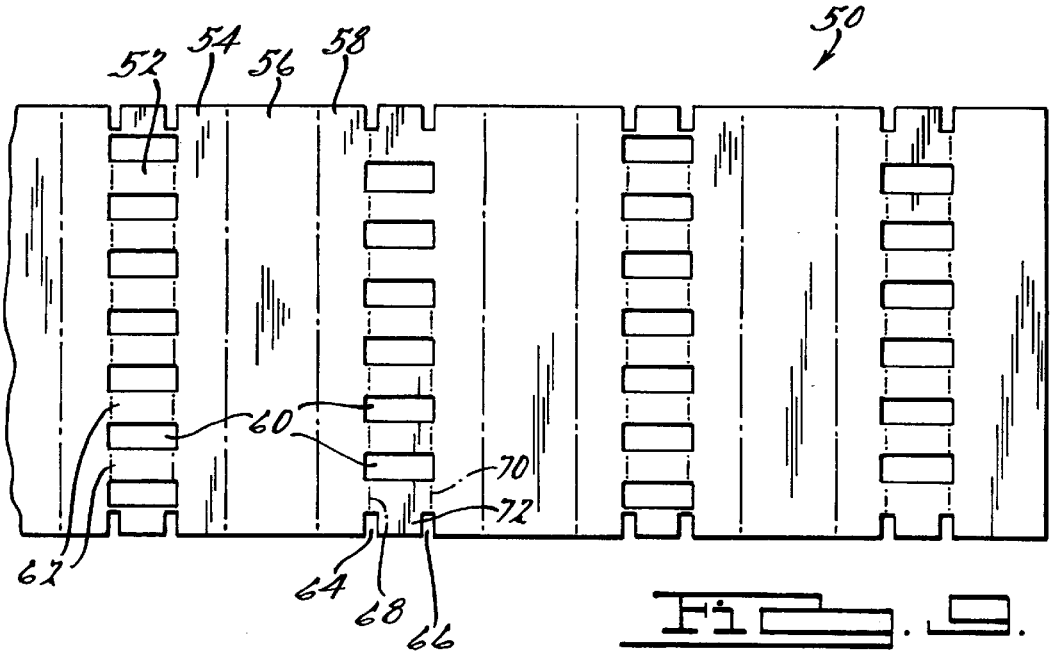
FIG. 9 is a fragmentary plan view of a strip member similar to that of FIG. 5 but showing another embodiment of the present invention.
Figure 11:
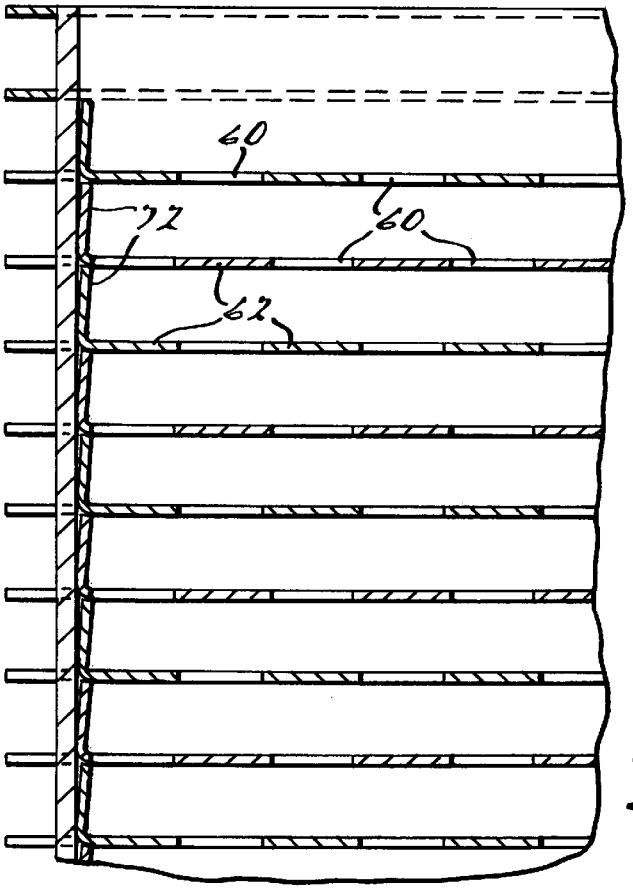
FIG. 11 is a section view of the heat exchanger core of FIG. 10, the section being taken along line 11—11 thereof.
Figure 10:
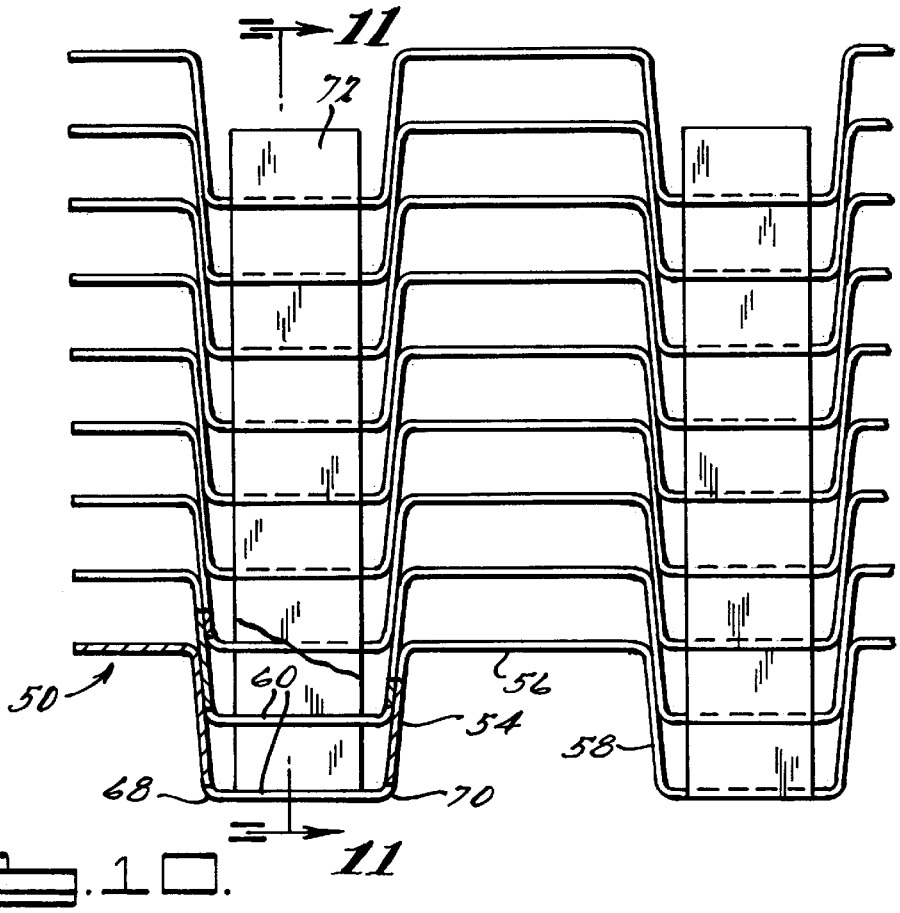
FIG. 10 is a fragmentary section view of a heat exchanger core similar to that of FIG. 3 but showing a heat exchanger core utilizing strips made in accordance with the embodiment of FIG. 9.

Referring now to FIGS. 9–11, another embodiment of the present invention is illustrated. In this embodiment, continuous strip material 50, substantially the same as in the embodiment described above, is utilized and includes in successive repetition a bottom wall portion 52, first side wall portion 54, flat portion 56, and second sidewall portion 58. While strip 50 is shown in FIG. 9 in flat form, the fold or forming lines separating the various portions and about which the strip will subsequently be formed are shown by dotted lines. However, in place of the relatively small louver-like openings 29 provided in the embodiment described above, bottom portion 52 has a plurality of generally rectangular shaped openings 60 formed with web portions 62 separating adjacent openings. As shown, each of the openings 60 will be substantially identical and will have a length in the longitudinal direction of strip 50 slightly greater than the width of bottom portion 52 and thus extend slightly into the respective adjacent first and second wall portions 54 and 58. While it is believed preferable to form openings 60 by completely removing the material therefrom, it is possible if desired to provide one or more tab portions from a portion of this material which may be formed to extend outwardly from one surface or the other of bottom portion 52 to thereby further aid in mixing of the fluid flowing therethrough. Additionally, openings 60 provided in successive bottom portion 52 will be laterally offset from each other such that a generally serpentine flowpath will be defined through the assembled heat exchanger core as shown in FIG. 11. This serpentine flowpath aids the thermal efficiency of the heat exchanger core by ensuring mixing of the fluid flowing therethrough thus minimizing the chances of thermal stratification of the fluid. It should be noted that while preferably web portions 62 will be slightly wider in the lateral direction of strip 50 than openings 60, it is possible if desired to vary the size of one relative to the other. For example, increasing the size of the openings 60 relative to the web portions 62 will reduce the flow resistance through the heat exchanger but at a cost of reduction in the transfer of heat from the fluid to the heat radiating flat portions 56. Likewise, decreasing the size of the openings 60 and increasing the size of the web portions 62 will increase flow resistance through the heat exchanger core but will also increase the heat transfer to the heat radiating flat portions 56.

As best seen with reference to FIG. 10, successive strips 50 are formed to their final shape cut to their desired length, and then stacked in nested relationship to form a heat exchanger core in substantially the same manner as described above with reference to the embodiment shown in FIGS. 2–8. Additionally, as with the previously described embodiment, bottom portions 52 of one strip 50 will be positioned in substantially coplanar relationship with the flat heat radiating portion 56 of a second adjacent strip 50 thus providing a very short and hence efficient heat transfer path. Additionally, this nested relationship will provide two thickness of strip material along the sidewalls thus ensuring enabling use of a thinner sheet material for forming the successive strips without sacrificing strength. Also, this overlapping relationship will provide a substantial surface area for sealing bonding of the sidewalls of the stacked strips together to thereby ensure a long-lasting leak-free heat exchanger core.

Referring once again to FIG. 9, strip 50 also has a plurality of pairs of notches 64, 66 provided along the opposite lateral edges in substantially equally spaced relationship. Notches 64, 66 are positioned in generally centered aligned relationship with the bending lines 68, 70 that define the edges of bottom portion 52 and define a tab portion 72 therebetween. As shown in FIGS. 10 and 11, tab portions 72 are subsequently bent upwardly to extend at an included angle slightly less than 90° with respect to bottom portion 52 and have a height equal to the distance between respective bottom portions 52 when strips 50 are assembled in stacked nested relationship. These tabs 72 aid in the assembly of respective strips 50 by acting as spacers to limit the nesting telescopic movement of the troughs of respective strips 50.

As noted above with respect to strips 18, strips 50 will preferably be fabricated from a continuous roll of sheet material by use of a suitable high speed press and thereafter cut to the desired length by severing along the center line of flat portion 56. The thus cut to length and finally formed strips are thereafter stacked in nested relationship, fitted with suitable end closure members such as closure members 38 described above and headers in a like manner as described above and subject to a suitable brazing process. It is believed preferable to use a sheet material 19 having a suitable brazable-type cladding material provided thereon for fabrication of strips 18 and 50 as shown in FIG. 5*a*. The cladding material will have a melting temperature less than that of the base material of strip 50 and may be in the form of a copper or copper alloy when steel is used as the base material for strips 18 or 50 or may be a suitable aluminum alloy when aluminum is used as the base material. The cladding may aid in reducing tool wear and will also provide the needed material to sealingly secure the strips together during an oven brazing operation. The base material for fabricating strips 18 or 50 may be either steel or aluminum and need have only one side thereof provided with the brazable cladding material.

As thus described, the present invention provides an extremely efficient heat exchanger design which can be easily and rapidly fabricated in a wide variety of sizes with minimal changeover of forming operations. Thus, the heat exchanger of the present invention is well suited for a wide variety of applications.

Figure 12:
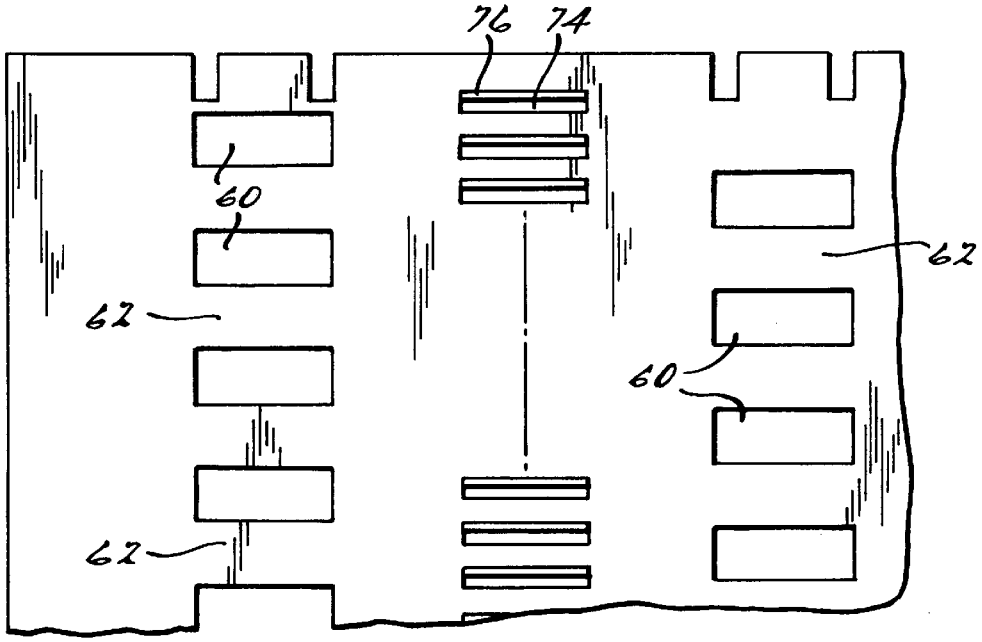
FIG. 12 is a view of the strip shown in FIG. 9 wherein the heat radiating fin portions are provided with louver-type openings therein.

While the two embodiments disclosed above are well suited for most any application, a third embodiment is shown in FIG. 12 which is believed to offer even greater thermal efficiency than the previously described embodiment. Strip 50' is substantially identical to strip 50 with the exception that flat portions 56 thereof are provided with a plurality of spaced louvered openings 74. Louvered openings 74 may be substantially the same as louvered openings 29 provided on bottom portion 26 of strips 18 and are formed in a similar manner by cutting along three sides thereof and then deforming the thus formed tab 76 outwardly from the plane of flat portion 56. If desired, successive ones of the tabs 76 or successive groups of tabs 76 may be deflected in opposite directions. The deflected tabs 76 will impart a disturbance to the flow of air over the flat portions 56 thus improving the heat transfer thereto. It is believed this embodiment is best suited for applications in which the likelihood of the air flow containing large amounts of debris is relatively low so as to minimize the potential for fouling of the heat radiating fins.

While it will be apparent that the preferred embodiments of the invention disclosed are well calculated to provide the advantages and features above stated, it will be appreciated that the invention is susceptible to modification, variation and change without departing from the proper scope or fair meaning of the subjoined claims.

I claim:

1. A core assembly for use in a heat exchanger comprising:

a plurality of elongated substantially identical strip members, each of said strip members including a plurality of longitudinally spaced laterally extending troughs with heat radiating fin portions extending therebetween, each of said troughs including a plurality of spaced openings therethrough, said strip members being positioned in stacked relationship with respective ones of said troughs of one strip member being in sealing nested relationship with at least one of an adjacent strip member, a plurality of closure members positioned in overlying relationship to the opposite lateral ends of said troughs and being sealingly secured to said stacked strip members whereby said troughs define a fluid flowpath from one end of said core assembly to the other end and said heat radiating fin portions define a fluid flowpath laterally through said plurality of stacked strip members.

2. A core assembly as set forth in claim 1 wherein each of said troughs includes a substantially planar bottom portion, said openings being provided in said bottom portion.

3. A core assembly as set forth in claim 2 wherein said bottom portion of one trough is positioned in substantially coplanar relationship with a heat radiating fin portion of a second adjacent strip member to thereby minimize the heat transfer path to said heat radiating fin portion.

4. A core assembly as set forth in claim 2 wherein each of said troughs is defined by a first sidewall extending from one heat radiating fin portion to said bottom portion and a second sidewall extending from another heat radiating fin portion to said bottom portion.

5. A core assembly as set forth in claim 4 wherein said first and second sidewalls extend from said bottom portion at an included angle slightly greater than 90°.

6. A core assembly as set forth in claim 4 wherein each of said first and second sidewalls are positioned in overlapping relationship with first and second sidewalls of a next adjacent strip member such that the sidewalls of said fluid flowpath defined by said troughs has a thickness equal to twice the thickness of said strip members over substantially the entire extent of said fluid flowpath.

7. A core assembly as set forth in claim 1 wherein said troughs extend across the entire lateral width of said strip member.

8. A core assembly as set forth in claim 1 wherein each of said openings includes an upstanding tab portion adjacent thereto, said tab portions being operative to disturb fluid flow through said troughs so as to minimize the occurrence of temperature gradients in said fluid flowing through said troughs.

9. A core assembly as set forth in claim 7 wherein said openings are in the form of louvers.

10. A core assembly as set forth in claim 7 wherein said openings are generally rectangular in shape and include web portions therebetween.

11. A core assembly as set forth in claim 10 wherein said web portions and said openings of one strip member are offset with respect to said web portions and openings of the next adjacent strip member such that an opening of said one strip member is positioned in substantially aligned overlying relationship to the web portion of said next adjacent strip member.

12. A core assembly as set forth in claim 11 wherein the width of said web portion in the lateral direction of said strip member is substantially equal to the width of said opening in the lateral direction of said strip member.

13. A core assembly as set forth in claim 12 wherein said troughs are defined by a substantially planar bottom portion and upwardly extending sidewall portions, said openings and said web portions being provided in said bottom portion.

14. A core assembly as set forth in claim 13 wherein said openings have a dimension in the longitudinal direction of said strip member such that they extend slightly into said sidewall portions.

15. A core assembly as set forth in claim 1 wherein each of said strip members comprises a base material having a cladding thereon, said cladding having a melting temperature less than that of said base material.

16. A core assembly as set forth in claim 1 wherein each of said troughs extends the entire lateral width of said strip member and further including a tab portion at opposite ends of said trough.

17. A core assembly as set forth in claim 16 wherein said tab portion extends upwardly from said trough and engages the trough of the next adjacent strip member.

18. A heat exchanger comprising:

a first header;

a second header;

a core assembly having a thickness, said first and second headers being connected to opposite ends of said core assembly, said core assembly including a plurality of substantially identical elongated strips, each of said strips including in repetitive sequence a substantially planar heat radiating fin portion, and a fluid flow portion having a fluid flowpath thickness in the direction of said thickness of said core assembly and including a first elongated sidewall portion extending at an angle from said heat radiating fin portion and extending laterally of said core assembly a distance substantially equal to said fluid flowpath thickness of said core assembly, a substantially planar laterally elongated bottom portion extending in substantially parallel spaced relationship to said heat radiating fin portion, and a second elongated sidewall portion extending at an angle to said bottom portion to the next adjacent heat radiating fin portion and extending laterally of said core assembly a distance substantially equal to said fluid flowpath thickness of said core assembly, said strips being arranged in stacked nested relationship with said first and second sidewalls of one strip sealingly engaging first and second sidewalls of a next adjacent strip, closures at opposite sides of said core assembly to close off laterally opposite sides of a fluid flowpath defined by said fluid flow portion;

each of said bottom portions being spaced apart and including a plurality of openings therein spaced along the lateral width of said strip whereby fluid may flow from one of said first and second headers through said core assembly to the other of said first and second headers.

19. A heat exchanger as set forth in claim 18 wherein said heat radiating fin portions include a plurality of longitudinally extending laterally spaced tabs extending outwardly therefrom.

20. A heat exchanger as set forth in claim 18 wherein said first and second sidewall portions of one strip are positioned in overlapping relationship with respective first and second sidewall portions of a next adjacent strip whereby the thickness of the sidewall portions of said core assembly are substantially equal to twice the thickness of said strips.

21. A heat exchanger as set forth in claim 18 wherein said first and second sidewalls extend from said bottom portion at an included angle slightly greater than 90°.

22. A heat exchanger as set forth in claim 18 wherein each of said openings includes an upstanding tab portion adjacent thereto, said tab portions being operative to disturb fluid flow through said troughs so as to minimize the occurrence of temperature gradients in said fluid flowing through said troughs.

23. A heat exchanger as set forth in claim 18 wherein said openings are in the form of louvers.

24. A heat exchanger as set forth in claim 18 wherein said openings are generally rectangular in shape and include web portions therebetween.

25. A heat exchanger as set forth in claim 24 wherein said web portions and said openings of one strip are offset with respect to said web portions and openings of the next adjacent strip such that an opening of said one strip is positioned in substantially aligned overlying relationship to the web portion of said next adjacent strip.

26. A heat exchanger as set forth in claim 18 wherein said openings have a dimension in the longitudinal direction of said strip such that they extend slightly into said sidewall portions.

27. A heat exchanger comprising:

a first header;

a second header;

a core assembly, said first and second headers being connected to opposite ends of said core assembly, said core assembly including a plurality of substantially identical elongated strips, each of said strips including in repetitive sequence a substantially planar heat radiating fin portion, a first sidewall portion extending at an angle from said heat radiating fin portion, a substantially planar bottom portion extending in substantially parallel spaced relationship to said heat radiating fin portion, and a second sidewall portion extending at an angle to said bottom portion to the next adjacent heat radiating fin portion, said first and second sidewall portions and said bottom portion define a trough extending laterally across the entire width of said strip, said strips being arranged in stacked nested relationship with said first and second sidewalls of one strip sealingly engaging first and second sidewalls of a next adjacent strip, said bottom portions of said one strip being in spaced substantially coplanar relationship with said heat radiating fin portions of said next adjacent strip, each of said bottom portions including a plurality of openings therein spaced along the lateral width of said strip whereby fluid may flow from one of said first and second headers through said core assembly to the other of said first and second headers, and closure members sealingly secured to opposite lateral edges of said strips to close off opposite ends of said trough.

* * * * *

UNITED STATES PATENT AND TRADEMARK OFFICE

CERTIFICATE OF CORRECTION

PATENT NO. : 6,065,533

DATED : May 23, 2000

INVENTOR(S) : Ivan D. Woodhull, Jr.

It is certified that error appears in the above-identified patent and that said Letters Patent is hereby corrected as shown below:

Column 1, line 4, after "was" insert --based upon--.

Column 4, line 56, "dose" should be --close--.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*